US008529775B2

(12) United States Patent
Costin et al.

(10) Patent No.: US 8,529,775 B2
(45) Date of Patent: Sep. 10, 2013

(54) DECORATIVE PRODUCTS CREATED BY LAZING GRAPHICS AND PATTERNS DIRECTLY ON SUBSTRATES WITH PAINTED SURFACES

(75) Inventors: Darryl J Costin, Westlake, OH (US); Darryl Costin, Jr., Westlake, OH (US); Richard C. Fishburn, Grafton, OH (US)

(73) Assignee: Revolaze, LLC, Westlake, OH (US)

( * ) Notice: Subject to any disclaimer, the term of this patent is extended or adjusted under 35 U.S.C. 154(b) by 935 days.

(21) Appl. No.: 12/034,130

(22) Filed: Feb. 20, 2008

(65) Prior Publication Data

US 2008/0241478 A1 Oct. 2, 2008

Related U.S. Application Data

(60) Provisional application No. 60/890,767, filed on Feb. 20, 2007.

(51) Int. Cl.
*B44C 1/22* (2006.01)

(52) U.S. Cl.
USPC ..... 216/28; 428/158; 428/913; 427/554

(58) Field of Classification Search
USPC ..... 216/28
See application file for complete search history.

(56) References Cited

U.S. PATENT DOCUMENTS 3,706,111 A * 12/1972 Curtin et al. ..... 15/207.2
4,024,545 A 5/1977 Dowling et al.
4,629,858 A 12/1986 Kyle
4,847,184 A 7/1989 Taniguchi et al.
4,861,620 A 8/1989 Azuma et al.
4,947,022 A 8/1990 Ostroff et al.
5,200,592 A 4/1993 Yabu
5,916,461 A 6/1999 Costin et al.
5,990,444 A 11/1999 Costin
6,002,099 A 12/1999 Martin et al.
6,007,929 A * 12/1999 Robertson et al. ..... 428/195.1
6,140,602 A 10/2000 Costin
6,171,383 B1 * 1/2001 Sakoske et al. ..... 106/479
6,252,196 B1 6/2001 Costin et al.
6,315,202 B2 11/2001 Costin et al.
6,495,237 B1 12/2002 Costin
6,576,862 B1 6/2003 Costin et al.
6,664,505 B2 12/2003 Martin
6,685,868 B2 2/2004 Costin (Continued)

FOREIGN PATENT DOCUMENTS

GB 2294656 5/1996
WO WO93/22944 11/1993

OTHER PUBLICATIONS

Sintec Optronics, Laser Marking Technologies, Aug. 29, 2005, Sintec Optrronics Pte Ltd, p. 1-38, as found on the internet http://sintecoptronics.com/ref/index.html.*

(Continued)

*Primary Examiner* — Binh X Tran
*Assistant Examiner* — David Cathey, Jr.
(74) *Attorney, Agent, or Firm* — Berenato & White, LLC

(57) ABSTRACT

A painted surface is processed by a laser beam to remove at least one layer of paint. The surface that is exposed may be the raw substrate material, e.g., wood or wood laminate, or may be another painted surface. The laser may engrave a pattern, e.g. a wood grain pattern.

5 Claims, 6 Drawing Sheets

(56) References Cited

U.S. PATENT DOCUMENTS

| | | | | |
|---|---|---|---|---|
| 6,746,724 | B1 * | 6/2004 | Robertson et al. | 427/555 |
| 6,753,501 | B1 | 6/2004 | Costin, Sr. et al. | |
| 6,807,456 | B1 | 10/2004 | Costin, Jr. et al. | |
| 6,819,972 | B1 | 11/2004 | Martin et al. | |
| 6,858,815 | B1 | 2/2005 | Costin | |
| 7,318,377 | B2 | 1/2008 | Espy et al. | |
| 7,699,896 | B1 | 4/2010 | Colwell | |
| 2004/0206029 | A1 * | 10/2004 | Luetgert et al. | 52/313 |
| 2007/0108170 | A1 | 5/2007 | Costin, Sr. et al. | |

OTHER PUBLICATIONS

Wikepedia, Medium-density fiberboard, Mar. 13, 2012, Wikepedia, p. 1-3.*

* cited by examiner

DECORATIVE PRODUCTS CREATED BY LAZING GRAPHICS AND PATTERNS DIRECTLY ON SUBSTRATES WITH PAINTED SURFACES

PROVISIONAL PRIORITY

The present application claims the priority from Provisional Application 60/890,767 filed Feb. 20, 2007.

BACKGROUND

Laser etching technology has since grown to become a sizable international market and an accepted engraving or marking technology in a host of industries ranging from medical and automotive to textile and electronics. It is used to identify parts, etch company logos and decorative artwork on substrates, serialize numbers, scribe graphics and patterns on apparel, and impart codes on different materials and a variety of other applications. Laser etching technology can and often does replace some sandblasting, chemical etching, embossing, screen printing and ink jet printing processes with a lower cost, high quality printed image being produced.

Our issued patents and copending applications, as well as other information, describe how a host of different graphics and patterns are lazed directly onto myriad substrates including but not limited to: wood, plastic, acrylic, glass, ceramic, textiles, leather, vinyl, marble, melamine, metals, alloys, composites, paper, mylar, rubber, foam, stone, polycarbonate, lexan, silicon, veneer, laminates, fiberglass, steel, tile, cork, and corian. The laser marks these substrates by several different means such as melting the surface, heating the surface to produce a color change, vaporizing the dye to produce a color change, annealing the surface, and actually engraving (by removing material on the surface) a mark with some depth of penetration. Sometimes, the substrates are sanded or coated after lazing to insure a clean and non charred surface.

The authors have been granted several patents on methods to laze graphics and patterns on leathers and textiles and have submitted several patent applications for lazing graphics and patterns on engineered wood and other building product substrates.

SUMMARY

The disclosure describes a method to laze graphics and patterns on painted substrates at specific laser power and laser scan speed ranges so as to selectively remove prescribed portions of the paint layers. The authors identify critical parameters to achieve the desired results at high performance levels, and thus opens a whole new degree of design freedom in lazing graphics and patterns on various substrates.

An aspect describes lazing graphics and patterns directly on painted surfaces. Exemplary paints include Sherwin Williams Woodscape and semi gloss paints and Behr semi gloss paints. The embodiments described herein contemplate lazing graphics and patterns on substrates covered with one or two layers of paints in creating new decorative products.

Some of the paints may need to be diluted with solvent, e.g., water to create the desired effect. The substrates could be engineered wood fiber, real wood, engineered plastic, real plastic, acrylic, glass, ceramic, textiles, leather, vinyl, marble, melamine, metals, alloys, composites, paper, mylar, rubber, foam, stone, polycarbonate, urethane, pvc and pvc composites, lexan, silicon, veneer, laminates, reaction injected molded parts, fiberglass, steel, tile, cork, corian; as well any other substrate that can be coated with paint.

An embodiment uses a laser to etch wood grain and other graphic patterns directly on the painted surface of wood fiber product substrates that have been coated with a paint such as Sherwin Williams Woodscape which has been diluted with 50% water. When this product is subsequently stained, it surprisingly assumes the appearance of real wood in that it is discolored yet has the real ticks or depth of real wood. It is critical to control the laser power levels and laser scan speed ranges to achieve the desired effects.

Another embodiment uses a laser to impart wood grain and other graphic patterns on wood fiber product substrates that have been coated with two layers of paint such as Sherwin Williams Woodscape for the base layer and Behr semi gloss for the top layer. At the specific laser power and scan speed levels disclosed, the laser etching assumes the color of the base paint layer of paint and the product surface assumes the color of the top layer of paint. For example, in the case where the base layer is dark brown and the top layer is chestnut color, the resultant laser etched product looks much like real oak. For the case where the base layer is black and the top layer is medium to dark brown, the resultant laser etched product looks much like real walnut.

Another embodiment uses a laser to etch other substrates coated with two layers of paint so as to achieve more contrast between the laser etching and the substrate part and to open up new design options that can generate a whole range of different colors for both the laser etching and the base part.

Another embodiment is the creation of totally new decorative products that can, for the first time, be produced by lazing graphic patterns on painted substrates to achieve laser etchings with the desired color and the product with the desired surface color for new design aesthetics.

Embodiments describe how substrates could be treated with one or more paint coatings and the laser power ranges and laser scan speed ranges controlled to remove specific depths of the paint layers in order to achieve extraordinary design effects never before realized. The embodiments teach how to produce new decorative products for a variety of industries ranging from building products to computers and electronics.

DETAILED DESCRIPTION

Figure 1:
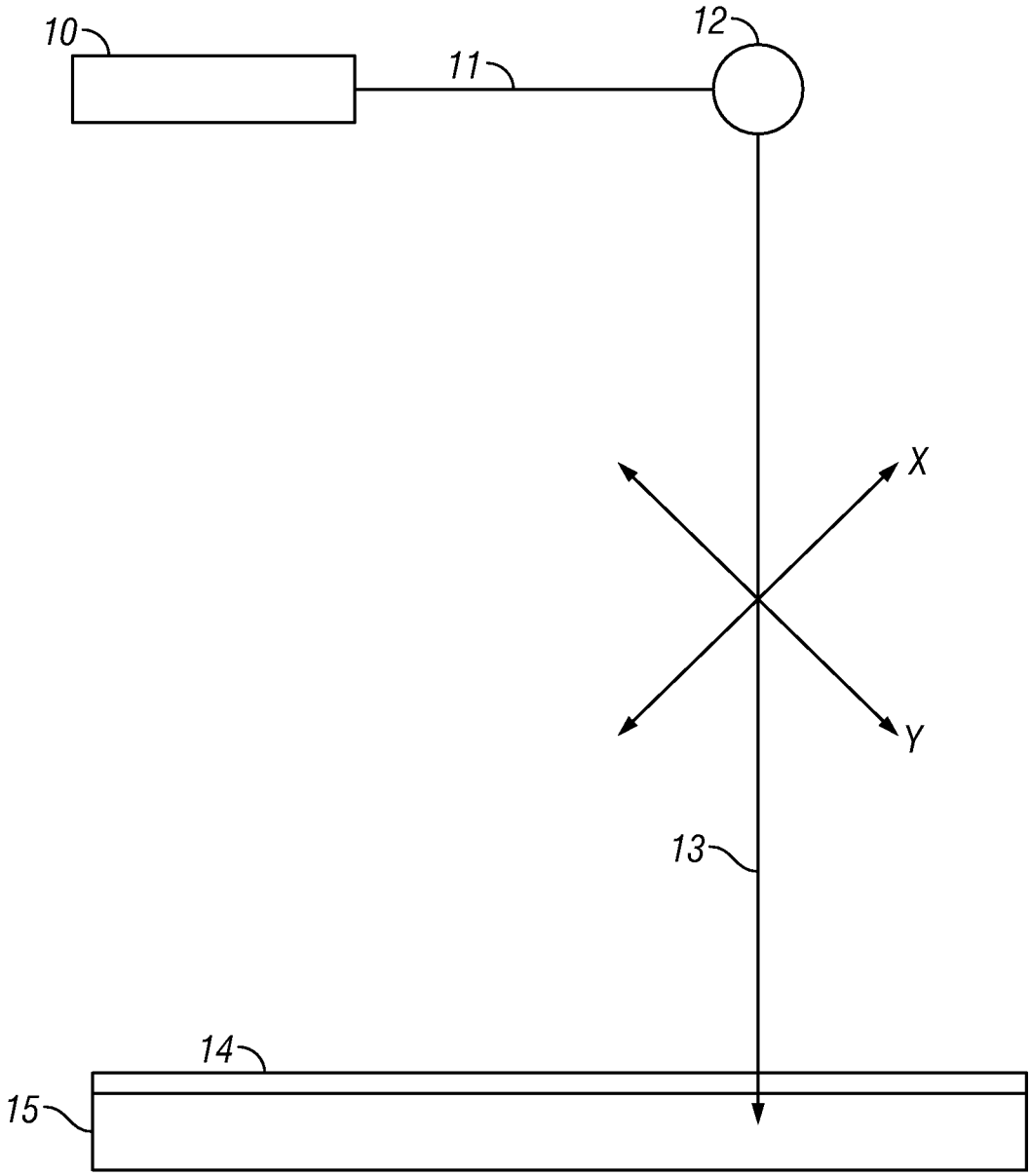
FIG. 1 is a schematic view of an embodiment of fully ablating away the laser etched portion of the top painted layer of a substrate with a laser so as to penetrate the substrate with the laser beam.

During the last ten years of experimenting with lazing different materials, the authors have noted that there are basic problems when lazing graphics and patterns directly on some substrates.

One problem deals with lazing wood grain and other patterns directly on engineered wood fiber product substrates. After staining, these products do not assume the appearance of real wood. The stained product appears very uniform in color and does not have the streaks or non uniformity in color as does real wood.

Another problem is that often the section that is laser etched is not clearly evident because the contrast between the laser etching and the base substrate is small or slight.

Yet another problem is that the color of the laser etching cannot be changed and hence always assumes the appearance of a characteristic of the color of the substrate, for example, the charring or the annealing or oxidation of the substrate or the color fading of the surface when the dye is removed. These three problems are further detailed below.

Relative to the first problem, lazing wood grain patterns directly on engineered wood and wood fiber product substrates at first look very good. However, once the lazed engineered wood fiber products are stained, the end product has a uniform color, and thus does not closely resemble the look of real wood, which tends to have a non-uniform color with streaks or areas of discolorations. The authors lazed wood grain patterns directly on particle board, medium density fiber board, heavy density fiber board, masonite, and other hard boards and observed this phenomena in each and every case. Once the lazed substrates were stained, the product had a very uniform color whether the stain was cherry, maple, walnut or mahogany. This is probably due to the uniformity of the surface of engineered wood fiber products. Real wood has streaks of color or discolorations on the surface.

Importantly, one cannot directly stain routed wood fiber products such as medium density fiberboard (MDF) because of the different densities in the surface and routed area of the substrate. The stain takes differently to each section and appears porous in the less dense routed section. Hence there would be a major benefit if a solution to these problems could be found where lazing wood grain patterns on engineered wood fiber products would result in products which look like real wood after the product is stained.

Relative to the second problem, the inventors noted that several substrates are not very responsive to the laser radiation and do not produce a very distinguishable mark or etching. In these cases, the contrast between the substrate and the laser mark is often slight as in the case of some engineered thermoplastics, metals, polyethylene, copolymer substrates, urethane, sheet molding compound products, fiberglass products, nylon, rubber, and wood fiber products. In some of these cases, the laser etching or mark may not be readily visible, and thus may be difficult to read under some conditions.

The inventors note a need for improving the contrast between the laser etching and the substrate for these particular substrates. This may open up new opportunities for laser etching which otherwise would not be available.

Relative to the third problem, there is a significant limitation to lazing graphics and patterns on many substrates—the color of the laser etching is always limited to some characteristic or color of the base substrate and cannot be changed. For example, lazing graphics directly on medium density fiberboard produces a medium brown laser etching on a somewhat lighter brown substrate. So if it was desired to expose a dark brown laser etching perhaps on a light brown substrate color, this would not be possible. Or if it was desired to have a lazed graphic pattern with a rosewood tint on a white engineered wood substrate, it would not be possible to achieve this look by directly lazing on the engineered wood and then painting or staining the product. Furthermore, if wood grain etchings were lazed directly on metal interior doors, the laser etched wood grain would be silver in color and not brown in color as real wood grains. So it would be a significant opportunity if these problems could be resolved and perhaps create whole new market segments for lazing graphics and patterns on substrates to achieve different design aesthetics.

The authors attempted to replicate real wood by laser etching wood grain patterns directly on engineered wood products such as particle board, medium density fiberboard, high density fiberboard, masonite, hard board and other wood fiber products. The authors lazed oak grain, cherry grain, walnut grain, mahogany grain and exotic wood grain patterns on these engineered wood substrates. In all cases, the laser etchings looked very much like actual wood grain patterns. However, when the lazed wood grain engineered wood fiber products were subsequently stained, the authors noted that there was one minor yet critical property that the lazed samples did not have relative to exactly replicating the look of real stained wood—the relative discoloration of the surface with slight streaks of dark and light sections. Examination of some real wood oak floors or cherry bookcases or walnut tables clearly reveals that often the real wood is somewhat non-uniform in color, with multiple yet slight shades of the same color and different tonal characteristics. The authors further believed that the problem was related to the actual surface of engineered wood in that it is basically monotone and uniform in color. So, if conventional engineered wood is stained, it simply cannot exactly replicate the color characteristics of real wood with the shades and discolorations on the surface.

This understanding, among other things, led the authors to consider other means to achieve authentic wood grain and other graphic patterns with a laser on engineered wood fiber substrates.

An embodiment describes first coating the workpiece substrate with one or more layers of paint. The resultant coated product is then lazed.

FIG. 1 shows a laser beam 11 produced by a traditional laser source 10 and through a series of galvo mirrors, lenses and optics housed in 12. The laser beam 13 is directed to the workpiece 15 which has been coated with one layer of paint 14. In this embodiment, the laser power and speed are controlled to apply a total amount of laser power that causes the laser beam to fully penetrate the top layer of paint 14 and partially penetrate the substrate 15. However, the total amount of power must not be so high that the substrate is undesirably burned, charred, or otherwise damaged. The techniques of applying energy density per unit time, as described in U.S. Pat. No. 5,990,444, for example, may be used for this purpose.

Conventional galvo mirrors housed in 12 can be used to direct the beam in the x and y directions to produce vector graphics or raster patterns on the substrate.

In an embodiment, this set up was used to generate wood grain patterns on engineered wood fiber products that were coated with diluted paint mixtures to get extraordinary results once the resultant products were stained. One embodiment may dilute the paint with solvent, e.g, water. Another embodiment may use another material other than its native solvent, e.g., a paint thinner or thinning agent, or other additive.

Figure 2:
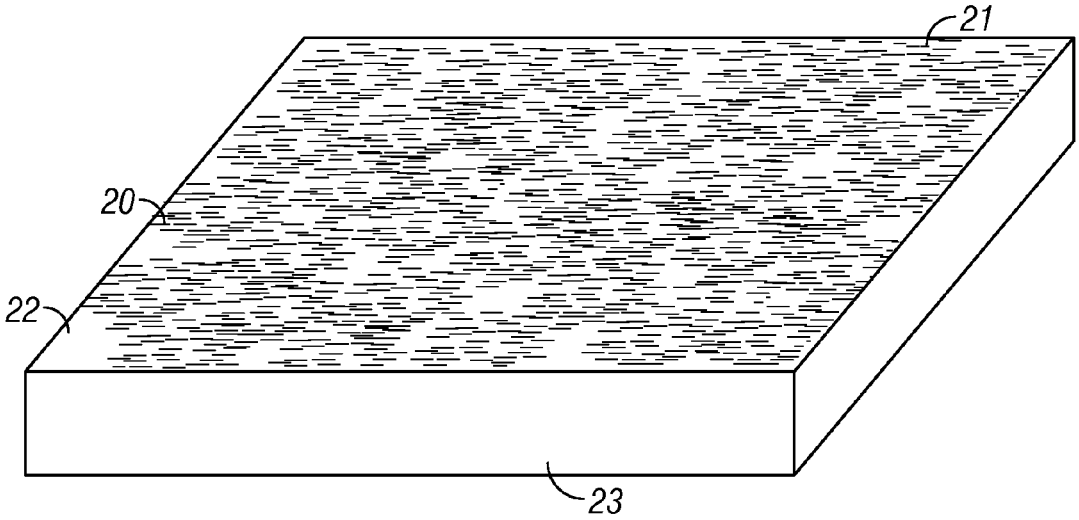
FIG. 2 is a schematic view of the wood grain pattern created on the painted engineered wood substrate

Such results reveal that the wood grain pattern has areas of normal wood grain pattern such as shown in 20 in FIG. 2 and areas of ticks as shown in 21. The ticks are areas of full laser penetration through the painted top layer 22 and partial laser penetration into the substrate 23. This effect which produces the texture or three dimensional effect similar to that of real wood. The wood grain pattern portion 20 is thus created with less total amount of applied laser energy than that of wood grain pattern portions 21.

Figure 3:
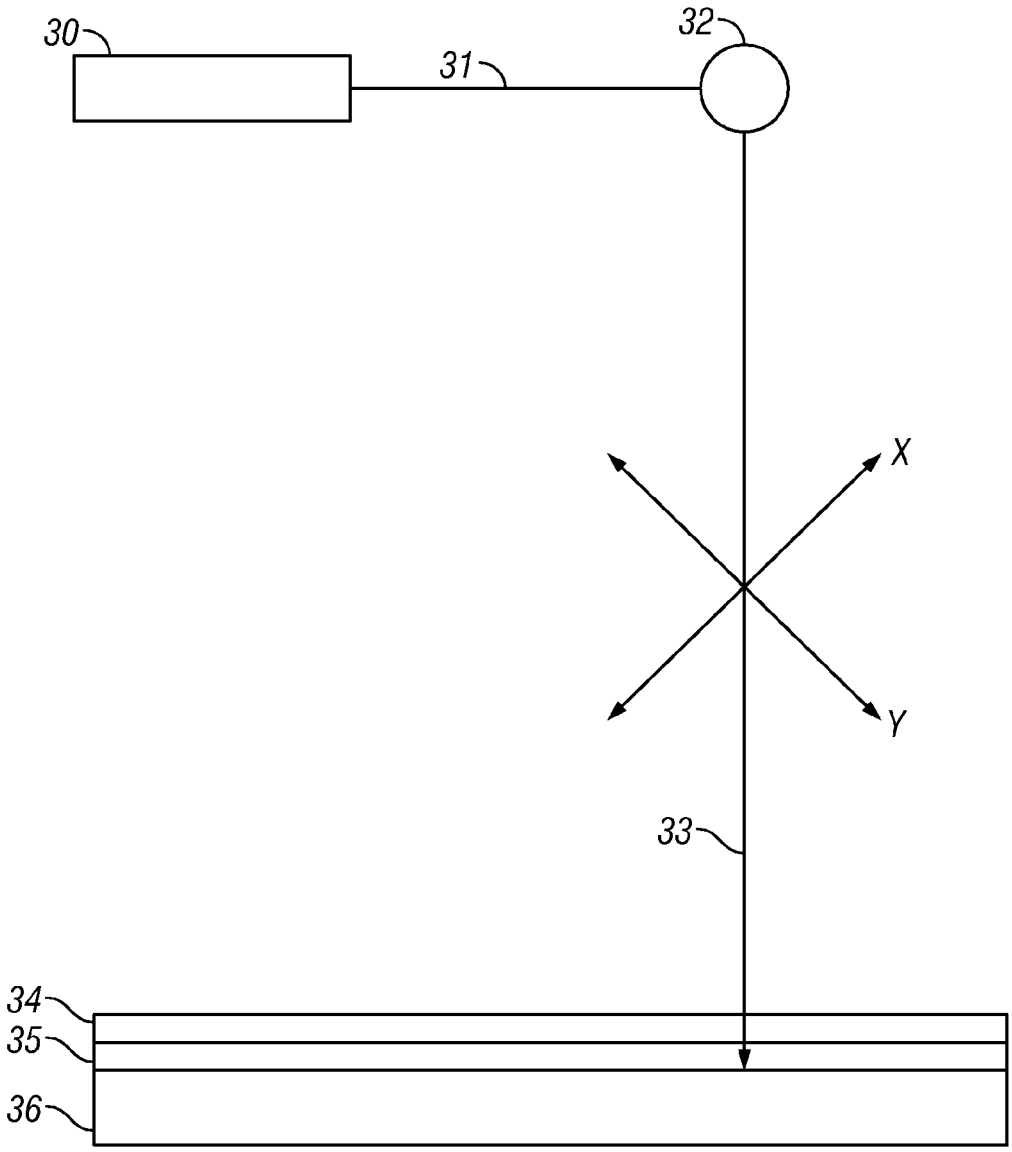
FIG. 3 is a schematic view of another embodiment of ablating away selective portions of the top painted layer of a substrate with a laser so as reveal the base layer paint color.

The authors then experimented with several other coating concepts and found that two layers of paint on the surface of engineered wood fiber substrates could produce some unusual, unexpected but significant results in lazing graphic patterns directly on the top layer of painted substrates. This embodiment is shown in FIG. 3 where a laser beam 31 is produced from a laser source 30 and directed to the workpiece surface 34 through conventional galvo mirrors, lens and optics housed in 32. However, in this case, the laser power and speed are controlled such that the laser beam 33 fully penetrates the top layer of paint 34 to reveal the second layer of paint 35 on the engineered wood fiber substrate 36.

Figure 4:
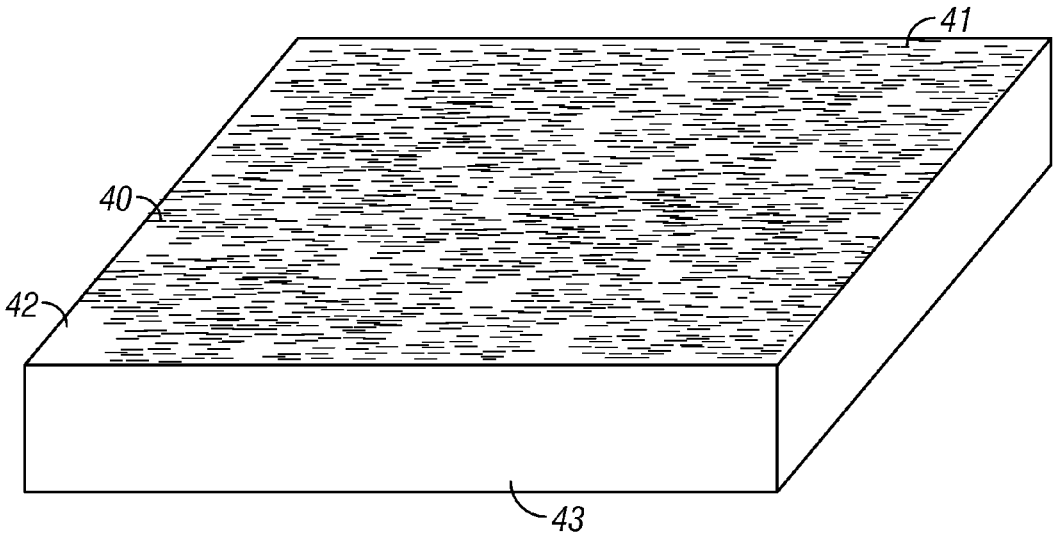
FIG. 4 is a schematic view of the wood grain pattern created on a substrate with two paint layers

In this embodiment, the authors learned that advantageous effects could be obtained when the laser power and speed were controlled so that the laser beam fully penetrated the first layer but not of sufficient intensity to fully penetrate the second layer. So under these conditions, the laser etching section shown in 41 in FIG. 4 would take on the color of the bottom layer of paint whereas the remaining portion of the surface or non etched portion 42 would take on the color of the top layer of paint 42. The laser could be made to partially penetrate the first layer of paint to reveal a different color etching as shown in 40. The extraordinary benefit of this embodiment is that the substrate becomes moot in this configuration such that any substrate which can take paint could be used. For example, steel, fiberglass, plastic, sheet molding compounds, reaction injected molded parts, pvc and pvc composites, ceramic, etc. can be used as the substrate and the color of the etching and background will have nothing to do with the substrate color. A whole new degree of design freedom can thus be introduced with this concept.

Figure 5:
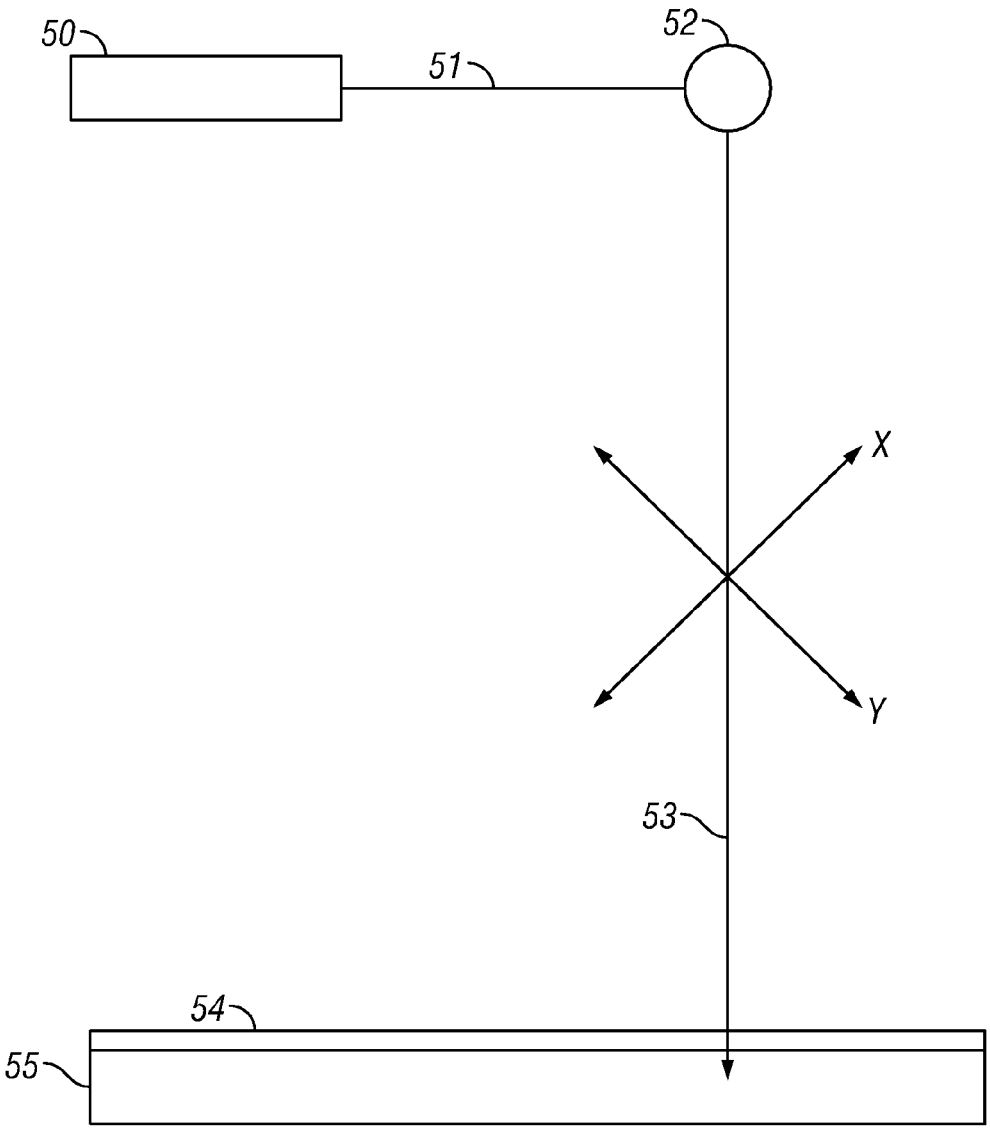
FIG. 5 is a schematic view of another embodiment of ablating away selective portions of the top painted layer of a substrate with a laser so as not to penetrate the substrate with the laser beam.

Another embodiment is shown in FIG. 5 for a one layer paint system. However, in this case, the laser power and speed are controlled in such a manner that the laser beam 53 partially penetrates the top layer of paint 54 on substrate 55 to produce a slight contrast between the paint color and the portion that is laser etched.

Figure 6:
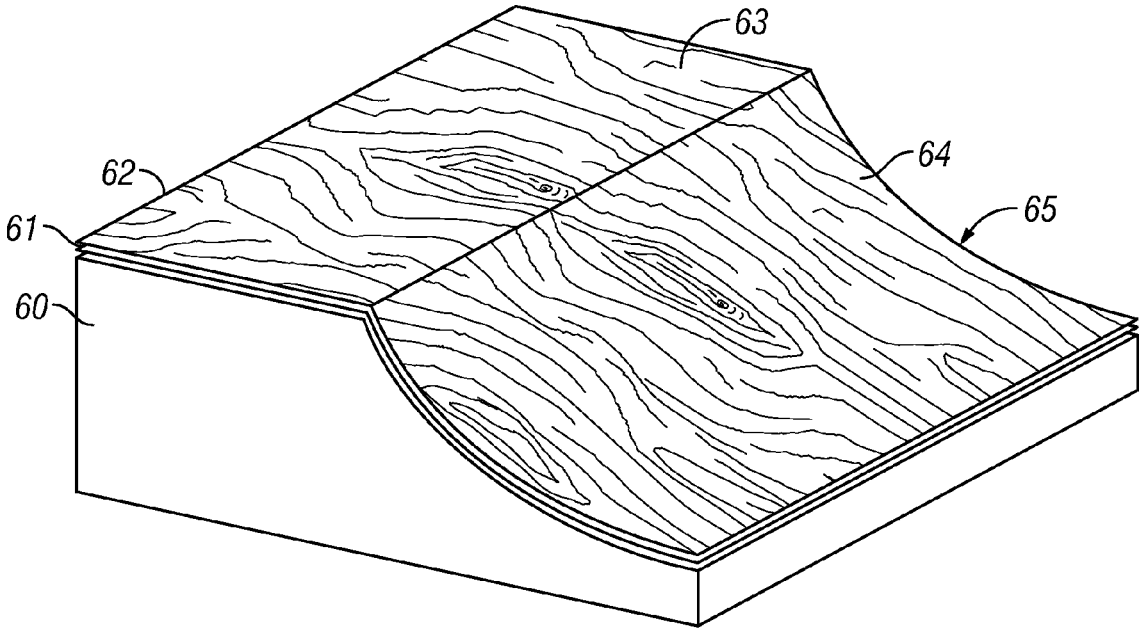
FIG. 6 is a schematic view of another embodiment of ablating away selective portions of the top painted layer of a substrate with a laser and with a substrate with different curvilinear geometries other than flat.

As a result of the concept to laze directly on painted surfaces versus lazing directly on the substrate, an embodiment that is novel in the area is the ability to laze on non flat or curvilinear sections as shown in FIG. 6. Here, the top layer of paint 62 and the bottom layer of paint 61 are shown on substrate 60 with curvilinear sections 65. However the laser etched wood grain pattern 63 appears the same on the flat section as the laser etched wood grain pattern 64 does on the curved section.

So the authors started to examine these embodiments by first applying a thin coat of paint on the surface of the engineered wood, lazing different wood grain patterns on the painted substrate, and finally staining the resultant product. The authors refer to this concept as the top laser wash coat. Experiments were then conducted with lazing engineered wood fiber product samples with different paints. The types of paint used included satin, satin latex, pigmented shellac, latex semi-gloss, flat enamel, waterborne acrylic, latex low sheen enamel, acrylic, flat, soft gloss, satin enamel, flat latex, low sheen enamel, low luster latex, mini-wax lacquer, clear shellac, clear conversion varnish, pigmented conversion varnish, from such manufacturers as Sherwin Williams, Behr, Gliddon, Ben Moore, True Value, and Ralph Lauren. Table I below reveals the results of the trials with a number of different paints at laser settings of 2,500 watts power, 20 meters/second scan speed and laser spot diameter of 0.75 mm.

TABLE I

Results of Different Paints Tested as The Top Layer for Single Layer System

| Paint Top Layer | Results |
|---|---|
| True Value Acrylic Latex | Poor - Did not penetrate top layer and substrate |
| Behr Flat Ultrapure White 1850 | Poor - Did not penetrate top layer and substrate |
| Behr Enamel | Poor - Did not penetrate top layer and substrate |
| SW Super Paint Satin Latex | Poor - Did not penetrate top layer and substrate |
| Behr Flat Pastel Base | Poor - Did not penetrate top layer and substrate |
| SW Super Paint Semi Gloss | Marginal - Not good penetration into top layer and substrate |
| SW Preprite Problock | Poor - Did not penetrate top layer and substrate |
| SW Super Paint Satin Latex | Poor - Did not penetrate top layer and substrate |
| SW Harmony Egg Shell | Poor - Did not penetrate top layer and substrate |
| SW Romar Low Sheen Enamel | Poor - Did not penetrate top layer and substrate |
| Kilz 2 Primer | Poor - Did not penetrate top layer and substrate |
| SW Perprite Pigmented Shellac | Poor - Did not penetrate top layer and substrate |
| Behr Satin Enamel | Poor - Did not penetrate top layer and substrate |
| SW Cashmere Flat Enamel | Poor - Did not penetrate top layer and substrate |
| Ben Moore Soft Gloss | Poor - Did not penetrate top layer and substrate |
| Ralph Lauren Interior Matte | Poor - Did not penetrate top layer and substrate |
| SW Cashmere Latex Low Lustre | Poor - Did not penetrate top layer and substrate |
| Gliddon Flat | Poor - Did not penetrate top layer and substrate |
| SW Pro 200 Satin | Poor - Did not penetrate top layer and substrate |
| Behr Semi Gloss Acent Base | Poor - Did not penetrate top layer and substrate |
| Behr Eggshell | Poor - Did not penetrate top layer and substrate |
| Behr Flat Ultrapure White 1050 | Poor - Did not penetrate top layer and substrate |
| Ben Moore Acrylic Eggshell | Poor - Did not penetrate top layer and substrate |
| SW Perfect Satin Latex | Poor - Did not penetrate top layer and substrate |
| SW Super Paint Flat Latex | Poor - Did not penetrate top layer and substrate |
| Behr Semi Glass Enamel | Marginal - Not good penetration into top layer and substrate |
| SW Promor 200 Semi Gloss | Poor - Did not penetrate top layer and substrate |
| Behr Satin Enamel Deep Base | Poor - Did not penetrate top layer and substrate |
| True Value Semi Gloss | Poor - Did not penetrate top layer and substrate |

In no case was the laser able to penetrate the top layer of the paint and penetrate the engineered wood substrate in sufficient depth to create the ticks or three dimensional effects of real wood. So the authors conceived of a unique concept of diluting the paint, here with water to allow the laser to perhaps better penetrate the top paint layer. The results of the laser trials at the same laser settings but the top layer of paint diluted with 50% water were very surprising and are shown in Table II below.

TABLE II

| Results of Diluted Paints Tested for Top Layer of One Layer System | |
|---|---|
| Diluted Paint Top Layer | Results |
| True Value Acrylic Latex | Acceptable penetration of top layer and substrate |
| Behr Flat Ultrapure White 1850 | Acceptable penetration of top layer and substrate |
| Ben Moore Latex Deep Base | Acceptable penetration of top layer and substrate |
| Ben Moore High Gloss Enamel | Acceptable penetration of top layer and substrate |
| SW Woodscape Solid Color | Acceptable penetration of top layer and substrate |
| Bullseye Shellac Seal Coat with Color | Acceptable penetration of top layer and substrate |
| Behr Interior Semi Gloss with Color | Acceptable penetration of top layer and substrate |
| Ben Moore Satin Acrylic Impervo | Acceptable penetration of top layer and substrate |
| Ben Moore Soft Gloss | Acceptable penetration of top layer and substrate |
| Ben Moore Acrylic Eggshell | Acceptable penetration of top layer and substrate |
| SW Super Paint Flat Latex | Acceptable penetration of top layer and substrate |
| Behr Satin Enamel Deep Base | Acceptable penetration of top layer and substrate |

Amazingly all paints tested worked fine when the paint was diluted with 50% water. It was clear that thinner paint as applied provides better results. And unexpectedly, when the lazed samples were stained, the resultant lazed engineered wood products appeared to look like real wood in that it had different tonal characteristics or non-uniform color and streaks with the ticks to represent the three dimensional characteristics of some wood.

It was critical to define the range of laser operating variables which produced the optimum results—sufficient energy density per unit time to ablate the top paint layer and penetrate into the engineered wood fiber substrate. It was necessary for the laser to penetrate into the wood fiber substrate so as to create the ticks or three dimensional effects of real wood. Accordingly, the range of laser operating variables tested were: laser power levels from 200 to 2,500 watts, laser scan speeds from 1 to 55 meters/second, laser frequency from 20 to 40 kHz, and a laser beam diameter from 0.5 to 1.5 mm.

Table III below summarizes the results for one particular paint system, Sherwin Williams Woodscape diluted with 50% water and a constant laser beam size of 0.75 mm diameter.

TABLE III

| Laser Etching Trials with Sherwin Williams Woodscape Diluted Paint on MDF Substrates | | | |
|---|---|---|---|
| Power (watts) | Speed (m/s) | Frequency (kHz) | Results |
| 2500 | >40 | 40 | Insufficient energy to penetrate first layer and MDF |
| 2500 | <40 > 5 | 40 | Sufficient energy to penetrate first layer and MDF to create good wood grain with depth |
| 2500 | <5 | 40 | Too much energy resulting in thick laser lines and too much depth of penetration into MDF |
| 1000 | >20 | 20 | Insufficient energy to penetrate first layer and MDF |
| 1000 | <20 > 1 | 20 | Sufficient EDPUT to penetrate first layer and MDF to create good wood grain with depth |
| 1000 | <1 | 20 | Too much energy resulting in thick laser lines and too much depth of penetration into MDF |
| 500 | >8 | 20 | Insufficient EDPUT to penetrate first layer and MDF |
| 500 | <8 > 0.5 | 20 | Sufficient energy to penetrate first layer and MDF to create good wood grain with depth |
| 500 | <0.5 | 20 | Too much energy resulting in thick laser lines and too much depth of penetration into MDF |

The authors proved that the laser must be controlled to specific power and scan speed levels in order to produce desired results. The laser power levels and scan speed needed to be controlled so that the laser could ablate the top layer of diluted paint and partially penetrate into the engineered wood fiber product substrate to achieve different levels of ticks. Good results were achieved at laser scan speeds between 5 meters/second and 40 meters per second for 2,500 watts of power, between 1 meter/second and 20 meters/second for 1,000 watts of power and between 0.5 meters/second and 8 meters/second for 500 watts of power.

There is an additional benefit associated with this particular embodiment. The additional benefit is that the laser can apply wood grain and other graphic patterns over routed and other sections with curvature or depth within a few inches or so. Hence substrates with some curvature or areas of different depth, for example kitchen cabinet doors, millwork, interior engineered wood fiber doors, etc. can all be processed in a way that provides a wood grain or other graphic pattern over the entire painted area.

Armed with these results, the authors conceived of a new concept in which multiple layers of paint in different combinations were applied to the engineered wood fiber product substrates in dual layer systems. For example, to obtain a walnut product look alike, the authors constructed samples with medium density fiberboard and hardboard substrates painted with a very black bottom layer of paint and a medium dark brown top layer of paint. When the laser etched through the top layer of paint, the color of the bottom layer of paint was revealed. So, it was possible then to achieve a realistic color walnut grain (black) on a brown shade for the top layer paint. The authors conducted a number of laser etching trials with different top layer paints in a two layer paint configuration on engineered wood fiber product substrates where the bottom layer was fixed as Sherwin Williams Woodscape and the laser settings were fixed at 2500 watts power, 30 meters/second scan speed and laser spot diameter of 0.75 mm. The results of these trials were most revealing as shown in Table IV below.

TABLE IV

Results of Different Paints Tested for Top Layer for Two Layer System

| Paint Top Layer | Results |
|---|---|
| True Value Acrylic Latex | Average - Not All Lines Penetrated |
| Behr Flat Ultrapure White 1850 | Good penetration of top layer to expose bottom layer |
| Behr Enamel | Poor - Not sufficient penetration of top layer |
| SW Super Paint Satin Latex | Poor - Not sufficient penetration of top layer |
| Behr Flat Pastel Base | Poor - Not sufficient penetration of top layer |
| SW Super Paint Semi Gloss | Great penetration of top layer to expose bottom layer |
| SW Preprite Problock | Poor - Not sufficient penetration of top layer |
| SW Super Paint Satin Latex | Average - Not All Lines Penetrated |
| SW Harmony Egg Shell | Poor - Not sufficient penetration of top layer |
| SW Romar Low Sheen Enamel | Poor - Not sufficient penetration of top layer |
| Kilz 2 Primer | Average - Not All Lines Penetrated |
| SW Perprite Pigmented Shellac | Poor - Not sufficient penetration of top layer |
| Behr Satin Enamel | Poor - Not sufficient penetration of top layer |
| SW Cashmere Flat Enamel | Poor - Not sufficient penetration of top layer |
| Ben Moore Soft Gloss | Poor - Not sufficient penetration of top layer |
| Ralph Lauren Interior Matte | Poor - Not sufficient penetration of top layer |
| SW Cashmere Latex Low Lustre | Poor - Not sufficient penetration of top layer |
| Gliddon Flat | Poor - Not sufficient penetration of top layer |
| SW Pro 200 Satin | Poor - Not sufficient penetration of top layer |
| Behr Semi Gloss | Great penetration of top layer to expose bottom layer |
| Behr Eggshell | Average - Not All Lines Penetrated |
| Behr Flat Ultrapure White 1050 | Poor - Not sufficient penetration of top layer |
| Ben Moore Acrylic Eggshell | Average - Not All Lines Penetrated |
| SW Perfect Satin Latex | Average - Not All Lines Penetrated |
| SW Super Paint Flat Latex | Poor - Not sufficient penetration of top layer |
| Behr Semi Glass Enamel | Average - Not All Lines Penetrated |
| SW Promor 200 Semi Gloss | Average - Not All Lines Penetrated |
| Behr Satin Enamel Deep Base | Poor - Not sufficient penetration of top layer |
| True Value Semi Gloss | Poor - Not sufficient penetration of top layer |

The authors noted that the choice of the bottom layer of paint was not critical, but the choice of the top layer of paint was indeed critical to the desired results. Amazingly the paints that seem to work the best were semi gloss paints from Sherwin Williams and Behr.

Next the authors experimented with the laser settings to determine the laser operating parameters such as speed and power which would allow the top layer of paint to be removed so as to reveal the color of the bottom layer of paint for the laser etched part. Thus, black wood grain patterns could be generated on medium brown substrates which looked very much like real walnut. The laser power, beam diameter, scan speed and frequency are controlled to ablate away only certain layers. For example, in a two paint system, these parameters could be controlled to ablate away only the top layer such that the color of the laser etching takes the color of the bottom layer. Further, the laser power, speed, frequency and beam diameter were critical to the results.

The range of laser operating variables tested were: laser power levels from 200 to 2,500 watts, laser scan speeds from 1 to 55 meters/second and a laser beam diameter from 0.5 to 1.5 mm. Table V below summarizes the results for two particular paint systems, Sherwin Williams Woodscape for the bottom layer and Behr Semi Gloss for the top layer and a constant laser beam diameter size of 0.75 mm.

TABLE V

Laser Etching Trials with Sherwin Williams Woodscape Paint and Behr Semi Gloss on Medium Density Fiberboard

| Power (watts) | Speed (m/s) | Frequency (kHz) | Results |
|---|---|---|---|
| 2500 | >50 | 40 | Insufficient energy to penetrate top layer |
| 2500 | <50 > 10 | 40 | Good penetration of top layer to expose bottom layer |
| 2500 | <10 | 40 | Too much energy such that both layers were penetrated |
| 1000 | >20 | 20 | Insufficient energy to penetrate top layer |
| 1000 | <20 > 2 | 20 | Good penetration of top layer to expose bottom layer |
| 1000 | <2 | 20 | Too much EDPUT such that both layers were penetrated |
| 500 | >10 | 20 | Insufficient EDPUT to penetrate top layer |
| 500 | <10 > 1 | 20 | Good penetration of top layer to expose bottom layer |
| 500 | <1 | 20 | Too much EDPUT such that both layers were penetrated |

The authors demonstrated that the laser should be controlled to specific power and scan speed levels in order to produce the desired results. The laser power levels and scan speed needed to be controlled so that the laser could ablate the top layer of paint without ablating the bottom layer of paint. Good results were achieved at laser scan speeds between 10 meters/second and 50 meters per second for 2,500 watts of power, between 2 meter/second and 20 meters/second for 1,000 watts of power and between 1 meters/second and 10 meters/second for 500 watts of power.

Next the authors tested the importance of thickness of each layer on the two paint system configuration. The results of the laser etching trials on two paint layers on engineered wood fiber substrates at laser power of 2,500 watts, scan speed at 30 meters/second and laser spot diameter at 0.75 mm is shown in Table VI below.

TABLE VI

Two Layer Paint Trials at Different Thicknesses

| Bottom Layer | Top Layer | Results |
|---|---|---|
| 2 Gloss | 2 Gloss | Almost no penetration into first layer |
| 1 Semi | 2 Semi | Limited penetration through first layer |
| 1 Semi | 1 Gloss | Limited penetration through first layer |
| 2 Gloss | 1 Gloss | Somewhat limited penetration through first layer |
| 1 Wood | 1 Gloss | Good penetration but average at 60% power |
| 2 Wood | 1 Semi | Good penetration but below average at 60% power |
| 1 Wood | 1 Semi | Great penetration even at 60% power |
| 3 Semi | 1 Semi | Great penetration even at 60% power |
| 1 Semi | 1 Semi | Great penetration even at 60% power |
| 2 Semi | 1 Semi | Good penetration even at 60% power |
| 1 Gloss | 1 Gloss | Limited penetration through first layer |
| 2 Semi | 2 Semi | Limited penetration through first layer |

The numbers in the tables refer to the number of layers sprayed. The results of these trials indicate that the thinner top coatings work best and that the thickness of the bottom layer appeared to be not critical to the results. These trials confirmed that the semi gloss paints worked best as the top layer of a two paint layer configuration.

With the two layer paint embodiment, the contrast between the laser etching color and the painted substrate color can be controlled to be anything from very light (as in the case of a two paint system where both paints are similar in color), or very significant as in the case of a two paint system where both paints are very dissimilar in color, for example a yellow undercoat with a purple overcoat. Therefore, one big advantage is that degree of contrast between the laser etching and the base material can be easily controlled by the selection of the colors of the bottom and top layers of paint.

It was interesting to discover that the selection of the substrate became somewhat irrelevant when the proper top layer of paint was used in the lazing trials. So for example, walnut wood grain patterns were lazed on a conventional steel interior door with a black bottom coat of Sherwin Williams Woodscape followed by a medium brown top coat of Behr semi gloss. The resultant product looked very much like a real walnut interior door. The same coatings were then applied to fiberglass and plastic components and the resultant lazed wood grain patterns looked equally as attractive and similar to the results with the engineered wood fiber substrates and the steel substrates, each of which were painted with the identical layers of paint.

This invention could be used to solve a major problem in the interior doors industry—the ability to match the stain of a conventional wood fiber interior door with traditional primed engineered wood fiber millwork. Building contractors report that it is very difficult to match the stain and color characteristics of these two products in the field when they are installed next to each other. So the millwork that surrounds an interior door may not look the same as the interior door. However, with the dual paint concept disclosed above, the authors were able to generate laser etched wood grain on engineered wood fiber millwork that perfectly matched laser etched hard board interior doors. A whole new degree of design freedom can now be created without limitation to the laser etched pattern or the color of the millwork and doors. For example, the authors created zebra stripes with red tonal characteristics on medium brown wood fiber product substrates with matching millwork by merely controlling the colors of each layer of paint.

The two paint layers can be fused together to create faded colors when lazed or not fused together to create non faded colors when lazed. Depending upon the material, a primer could be applied before the surface was painted. Finally, with three or more layers of paint, different parts of the laser etching could assume different colors because the laser power and scan speed could be controlled by changing the energy density per unit time in different sections of the etchings.

The authors also discovered a solution to the major problem with staining routed wood fiber products. One cannot directly stain routed wood fiber products such as medium density fiberboard because of the different densities in the surface and routed area of the substrate. Often expensive sanding processes must be used to achieve similar densities for these two sections. However, during the paint trials, the authors noted that a shellac type coating could be applied over the routed sections that have been sanded such that once the stain was applied, the engineered wood product would look very good. Further, the routed engineered wood could be lazed after sanding and application of the shellac coating and then stained to achieve an excellent product.

Although only a few embodiments have been disclosed in detail above, other embodiments are possible and the inventors intend these to be encompassed within this specification. The specification describes specific examples to accomplish a more general goal that may be accomplished in another way. This disclosure is intended to be exemplary, and the claims are intended to cover any modification or alternative which might be predictable to a person having ordinary skill in the art. For example, other numbers of layers could be used. Other kinds of paints, that use thinners other than water can be used. Other thinners, can also be used, even in a water base paint.

Also, the inventors intend that only those claims which use the words "means for" are intended to be interpreted under 35 USC 112, sixth paragraph. Moreover, no limitations from the specification are intended to be read into any claims, unless those limitations are expressly included in the claims. The computers described herein may be any kind of computer, either general purpose, or some specific purpose computer such as a workstation. The computer may be a Pentium class computer, running Windows XP or Linux, or may be a Macintosh computer. The computer may also be a handheld computer, such as a PDA, cellphone, or laptop.

The programs may be written in C, or Java, Brew or any other programming language. The programs may be resident on a storage medium, e.g., magnetic or optical, e.g. the computer hard drive, a removable disk or media such as a memory stick or SD media, or other removable medium. The programs may also be run over a network, for example, with a server or other machine sending signals to the local machine, which allows the local machine to carry out the operations described herein.

What is claimed is:

1. A method comprising:

applying and moving a laser beam having a power level between 500 and 5,000 watts and a speed between 0.5 and 65 meters per second relative to a painted substrate comprising a substrate layer, a first layer of paint overlaying the substrate layer, and a second layer of paint overlaying the first layer of paint, wherein the first layer of paint has a first color and the second layer of paint has a second color different than the first color; and etching the painted substrate with the laser beam to form a graphic, the laser beam fusing the first layer of paint and the second layer of paint together.

2. A method as in claim 1, wherein the substrate layer comprises wood fiber.

3. A method as in claim 2, wherein the graphic is a wood grain pattern.

4. A method as in claim 1, wherein the substrate layer comprises at least one member selected form the group consisting of steel, metal and alloy.

5. A method as in claim 1, wherein the substrate layer comprises at least one member selected from the group consisting of plastic, PVC, and urethane.

* * * * *